United States Patent [19]

Chubb et al.

[11] 4,364,254

[45] Dec. 21, 1982

[54] COMBINED SHEET BENDING BRAKE, TABLE AND COIL SUPPORT

[75] Inventors: Arthur B. Chubb, Wyandotte; James J. Rhoades, Garden City, both of Mich.

[73] Assignee: Tapco Products Company, Inc., Detroit, Mich.

[21] Appl. No.: 185,276

[22] Filed: Sep. 8, 1980

[51] Int. Cl.[3] ..... B21D 5/04; B21D 7/06; B21D 43/00

[52] U.S. Cl. ..... 72/319; 72/294; 72/307; 72/320

[58] Field of Search ..... 72/319–323, 72/294, 307, 306, 419

[56] References Cited

U.S. PATENT DOCUMENTS

| | | | |
|---|---|---|---|
| 2,438,319 | 3/1948 | Kilham | 72/319 |
| 2,942,643 | 6/1960 | Pucci et al. | 72/419 |
| 3,152,631 | 10/1964 | Coffey | 72/294 |
| 3,161,223 | 12/1964 | Marsh | 72/319 |
| 3,251,208 | 5/1966 | Mittermaier | 72/319 |
| 3,269,164 | 8/1966 | Rutter | 72/294 |
| 3,301,034 | 1/1967 | Boettcher | 72/321 |
| 3,559,444 | 2/1971 | Blazey et al. | 72/319 |
| 3,662,584 | 5/1972 | Jones, Jr. et al. | 72/321 |
| 3,686,921 | 8/1972 | Roper | 72/294 |
| 3,817,075 | 6/1974 | Marsh et al. | 72/319 |
| 4,246,817 | 1/1981 | Marsh et al. | 83/455 |

*Primary Examiner*—Daniel C. Crane

*Attorney, Agent, or Firm*—Barnes, Kisselle, Raisch & Choate

[57] ABSTRACT

A combined sheet bending brake, table and coil support. The sheet bending brake includes a base, a first bending member having a clamping surface mounted on the base and a second bending member having a bending surface hinged to the first member, an anvil member extending longitudinally of the first bending member which clamps a workpiece by applying pressure to the anvil member to clamp the workpiece on the clamping surface of the first member. The table is mounted on the sheet bending brake, and extends horizontally and rearwardly of the brake along the base. The coil support comprises a base, a pair of supports carried by the base, which include a plurality of rollers for supporting a roll of sheet stock, and clamping surface on which the edge of the uncoiled sheet stock is clamped. The coil stand is mounted on the base of the sheet bending brake such that the axis of the roll of sheet stock extends transversely of the longitudinal axis of the sheet bending brake.

22 Claims, 6 Drawing Figures

COMBINED SHEET BENDING BRAKE, TABLE AND COIL SUPPORT

This invention relates to portable devices for handling of sheet material such as used for trimming buildings with aluminum or plastic sheet.

BACKGROUND AND SUMMARY OF THE INVENTION

Portable sheet bending brakes have come into extensive use on the job site for bending sheet material which is applied as siding or window trim to buildings. Typical sheet brakes are shown in U.S. Pat. Nos. 3,161,223, 3,559,444 and 3,817,075.

More recently, it has been proposed in United States Application Ser. No. 024,505, filed Mar. 28, 1979, now U.S. Pat. No. 4,246,817 that a portable stand for dispensing rolled sheet be provided which will provide a means for cutting predetermined lengths of sheet material from a roll on the job site.

The present invention is directed to a combined sheet bending brake, table and coil support which will permit the uncoiling of the sheet material from a coil stand, severing it from the remainder of the coil, and then immediately transferring to the sheet bending brake for bending.

In accordance with the invention, a table is mounted on the sheet bending brake and extending horizontally and rearwardly from the clamping surface of the sheet bending brake and a coil stand is mounted on the end of the sheet bending brake such that the axis of the roll of sheet stock extends transversely of the longitudinal axis of the sheet bending brake so that a length of sheet material can be unrolled from the coil stand onto the table, severed from the remainder of the uncoiled stock in the coil stand and manually transferred from the table to the sheet bending brake for bending.

DESCRIPTION

In accordance with the invention, the combined bending brake, table and coil support comprises a conventional sheet bending brake 10 such as shown in U.S. Pat. Nos. 3,161,223, 3,559,444 and 3,817,075, a table 11 mounted on the brake, and a coil stand 12 such as shown in the aforementioned U.S. Pat. No. 4,246,817 mounted at one end of the sheet bending brake.

The sheet bending brake is of conventional construction.

Figure 1:
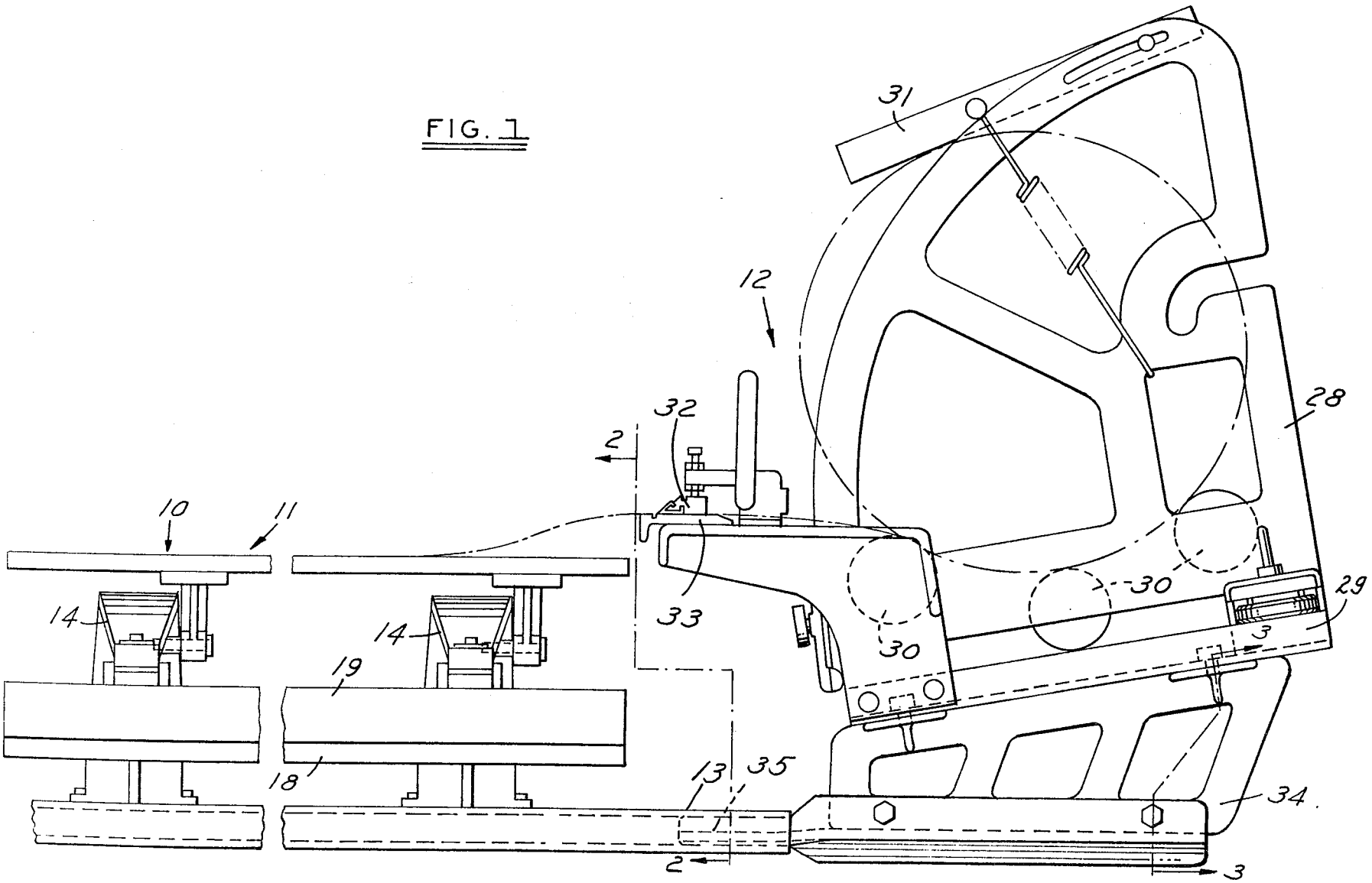
FIG. 1 is a fragmentary side elevational view of the combined sheet bending brake, table and coil support embodying the invention.
Figure 2:
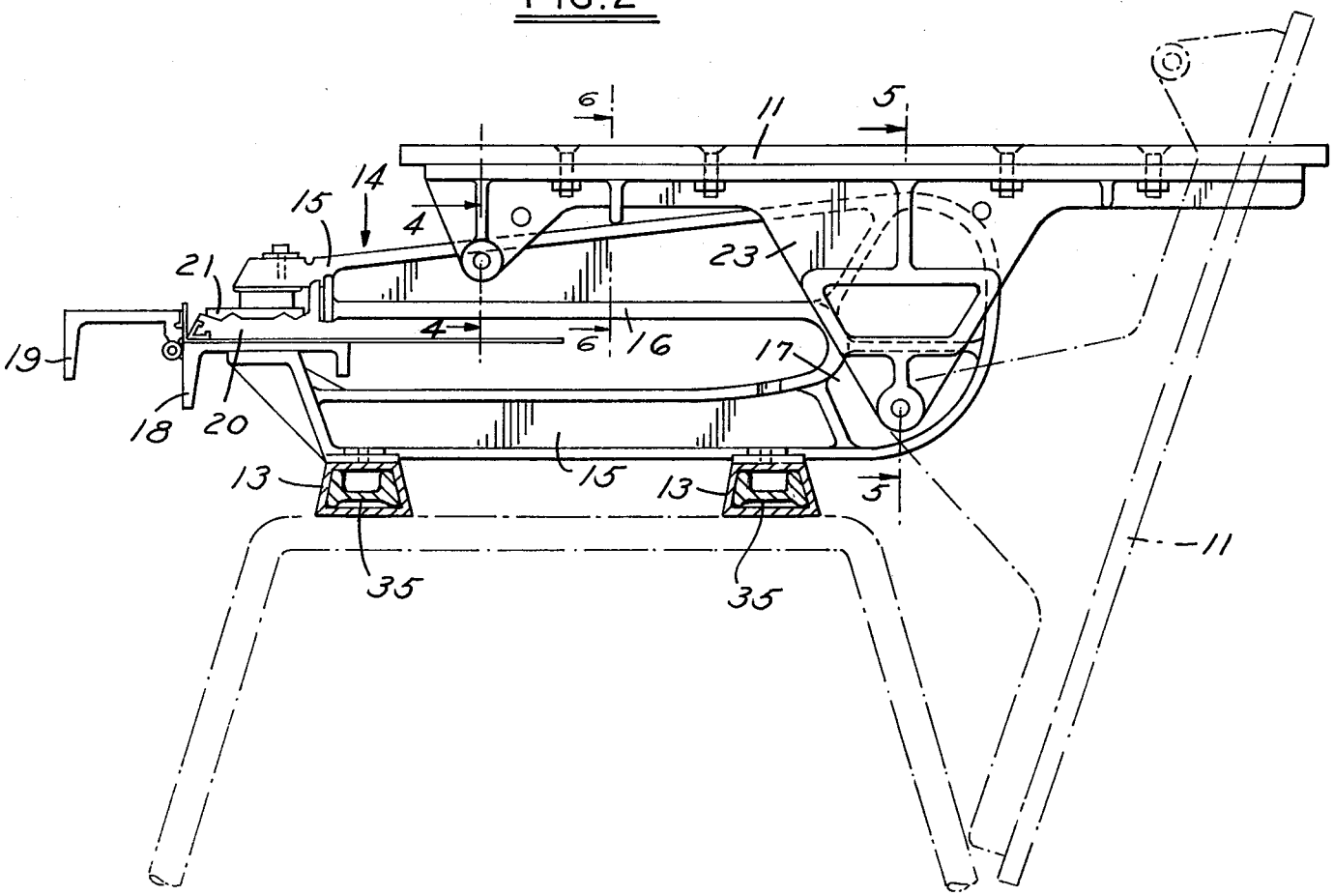
FIG. 2 is a fragmentary sectional view taken along the line 2—2 in FIG. 1.

Referring to FIGS. 1 and 2, the sheet bending brake embodying the invention comprises a pair of spaced tubular channel members 13 formed of aluminum extrusions and longitudinally spaced C-shaped members 14 comprising aluminum castings bolted to the rails 13. Each C-shaped member 14 includes a lower arm 15, an upper arm 16 and an intermediate portion 17. The lower arms 15 are bolted to the rails 13.

A first member 18 in the form of an inverted channel is fixed on the lower leg 15 and a second channel 19 is hinged along one edge ot the channel 18. Members 18, 19 are formed with mating integral projections along their adjacent longitudinal edges that are made by machining the edges along flat transverse planes. The projections are provided with aligned openings and a hinge pin is inserted in the openings to complete the hinge.

The upper surface of member 18 provides a clamping surface and a generally L-shaped anvil member 20 is provided in overlying relation to the clamping surface of the member 18. The anvil member 20 includes a sharp longitudinally extending edge adjacent the hinge line.

A pressure or backing plate 21 is provided in overlying relationship to the anvil member 20. The pressure member 20 is adapted to be moved by shifting a manual lever to wedge the pressure member 21 downwardly onto the anvil member 20 to clamp a piece of metal or plastic sheet material between the anvil member 20 and the first member 18. Swinging member 19 bends the sheet material.

The aforementioned United States Patents are referred to for further details of the sheet bending brake and are incorporated herein by reference.

Figure 5:
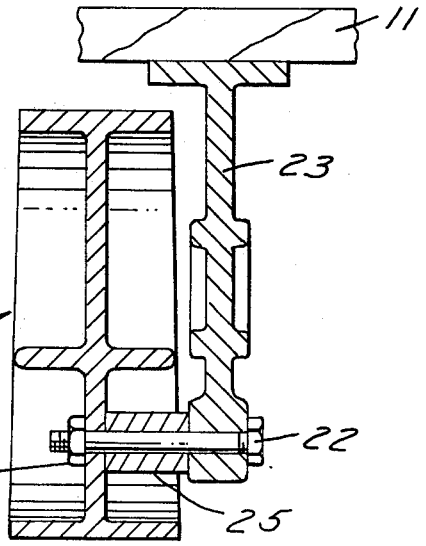
FIG. 5 is a fragmentary sectional view taken along the line 5—5 in FIG. 2.

The table 11 is mounted on a plurality of longitudinally spaced brackets which are pivoted to the C-shaped members in the area of juncture of the upper and lower arms and preferably adjacent the lower arm by an arrangement which includes bolts 22 extending through the brackets 23 on the underside of table 11 and nuts 24 threaded on the bolts with a spacer 25 between each bracket 23 and arm (FIG. 5).

Figure 4:
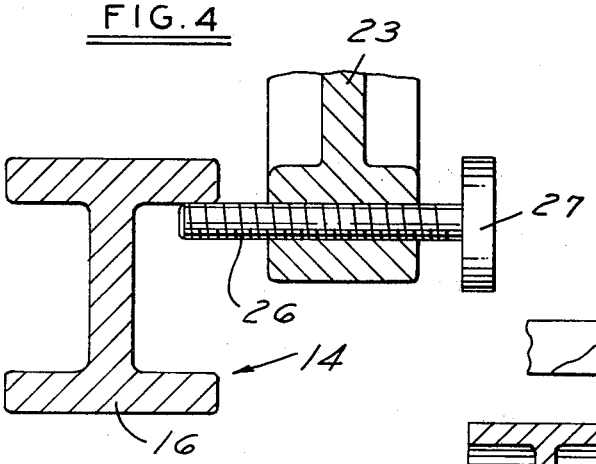
FIG. 4 is a fragmentary sectional view taken along the line 4—4 in FIG. 2.
Figure 6:
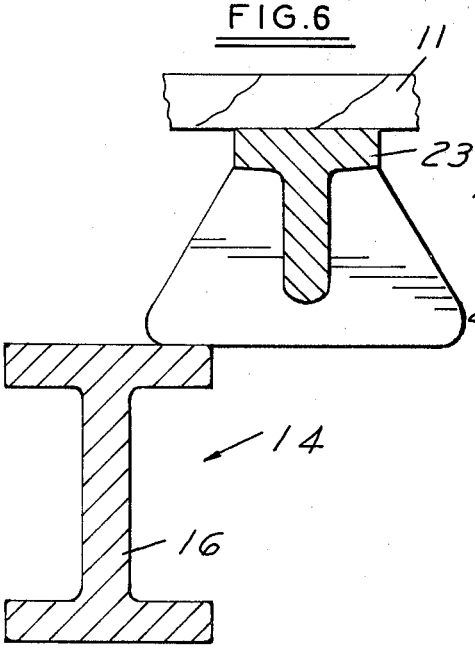
FIG. 6 is a sectional view taken along the line 6—6 in FIG. 2.

As shown in FIG. 4, a bolt 26 with a hand knob 27 is threaded to a downwardly extending portion of some of the brackets 23 to extend beneath a flange of the upper arm 16 and limit the upward movement of the table 11 retaining the table 11 in generally horizontal position with respect to the horizontal clamping surface of the brake 10. As shown in FIG. 6, a flange **23*a* extends downwardly to engage upper arm 16. When the knob 27 is rotated to retract the bolt 26, the table 11 can be pivoted rearwardly to the broken line position shown in FIG. 2** out of the area of the sheet bending brake.

The coil stand 12 for dispensing sheet material comprises a pair of supports 28 carried by a base 29, one of which is preferably adjustable longitudinally of the base to accommodate sheet rolls of differing widths. An arcuate array of rollers 30 is carried by each support 28 with the rollers of the supports being in opposed coaxial pairs. A pair of low friction spring biased keeper bars 31 are carried by the respective supports 28 to hold a roll of sheet stock against the rollers for free rotation. A cutting bar 32 is cantilevered from the base for selectively clamping unrolled sheet stock against a support surface 33 and provides a cutting edge for cooperation with a utility knife or the like for manually severing a desired amount of uncoiled sheet stock.

The aforementioned U.S. Pat. No. 4,246,817 is referred to for details of the coil stand and is incorporated herein by reference.

Figure 3:
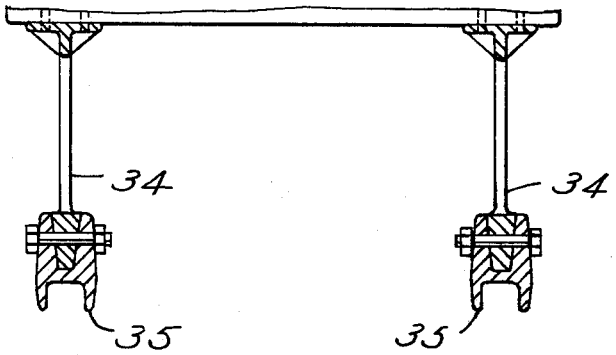
FIG. 3 is a sectional view taken along the line 3—3 in FIG. 1.

The coil stand is mounted on the end of the sheet bending brake by spaced brackets 34 which extend into grooves of brackets 35 (FIG. 3) that include projections telescoped within the ends of the base rails 13 of the sheet bending brake. Each bracket 34 has a surface that is inclined upwardly and to the right as viewed in FIG. 1 so that when the base 29 of the coil stand 12 is bolted thereto, the plane of the clamping surface 33 of the coil stand is generally parallel to the operational position of the table 11 and the clamping surface of the sheet bending brake 10.

Although it is preferred that the brackets extend into tubular rails of the brake, other means of removably fastening the brackets to the rails may be used when the rails are not tubular.

It can thus be seen that there has been provided a combined sheet bending brake, table and coil support which will permit uncoiling of the sheet material from the coil stand, severing it from the remainder of the coil and immediately transferring it to the sheet bending brake. The coil stand is preferably removably mounted on the end of the sheet bending brake opposite the end of the brake having the operating handle for clamping the sheet material and is readily removable to facilitate the transport of the brake and coil support from one job site to another.

The table and coil support can be readily applied to brakes to convert them to the combined brake, table and coil support.

We claim:

1. A combined sheet bending brake, table and coil support comprising a sheet bending brake including a base, a first bending member having a clamping surface mounted on said base, a second member having a bending surface, means for hinging said second member to said first member, an anvil member extending longitudinally of said first bending member, and means for clamping a workpiece by applying pressure to said anvil member to clamp a workpiece on the clamping surface of the first member, a table mounted on said sheet bending brake, said table extending horizontally and rearwardly from the anvil along the base, and a coil support comprising a base, a pair of supports carried by the base, said supports including means for supporting a roll of sheet stock, means carried longitudinally of the base of said coil support and transversely of the base of the sheet bending brake for defining a flat clamping surface, and means for clamping the edge of the uncoiled sheet stock against said last-mentioned surface, and means for mounting the base of said coil stand on the base of said sheet metal brake such that the axis of the roll of sheet stock extends transversely of the longitudinal axis of the sheet bending brake, means for mounting said table for movement from a position generally horizontal with respect to said clamping surface to a position rearwardly of said base of said sheet brake, said last mentioned means pivoting said table about an axis generally longitudinally of said brake, said table being positioned with respect to said coil support so that uncoiled sheet stock can be supported thereon over said sheet bending brake.

2. The combined sheet bending brake, table and coil support set forth in claim 1 wherein said means for mounting said table comprise a plurality of longitudinally spaced brackets pivoted to said sheet bending brake and supporting said table.

3. The combined sheet bending brake, table and coil support set forth in claim 2 wherein said sheet bending brake includes a plurality of C-shaped members positioned on said base at longitudinally spaced points, each said C-shaped member comprising a lower arm fixed to said base and an upper arm spaced from and overlying said lower arm, said first member being fixed on the lower arms of said C-shaped members, said brackets being pivoted to said C-shaped members adjacent the juncture of the upper and lower arms.

4. The combined sheet bending brake, table and coil support set forth in claim 3 wherein said bracket includes portions thereof adapted to engage portions of the upper arm to position said table in horizontal position.

5. The combined sheet bending brake, table and coil support set forth in claim 4 wherein said last mentioned means comprises a member on at least some of said brackets adapted to extend horizontally and engage a laterally extending portion of said C-shaped members.

6. A combined sheet bending brake, table and coil support comprising a sheet bending brake including a longitudinally extending base, a first member having a clamping surface mounted on and extending longitudinally of said base, a second member having a bending surface, means for hinging said second member to said first member about an axis extending longitudinally of said first member, an anvil member extending longitudinally of said first bending member, and means for clamping a workpiece by applying pressure to said anvil member to clamp a workpiece on the clamping surface of the first member, a table mounted on said sheet bending brake, said table overlying the sheet bending brake and extending horizontally and rearwardly from the anvil and longitudinally along the base, said table having an upper surface substantially planar and uninterrupted, and a coil support comprising a base, a pair of supports carried by the base, said supports including means for supporting a roll of sheet stock, means carried longitudinally of the base of said coil support and transversely of the base of the sheet bending brake for defining a flat clamping surface, and means for clamping the edge of the uncoiled sheet stock against said last mentioned surface, and means for mounting the base of said coil stand on the base of said sheet metal brake such that the axis of the roll of sheet stock extends transversely of the longitudinal axis of the sheet bending brake, said table being oriented over said sheet bending brake in a position adjacent the clamping means of the coil support so that uncoiled sheet stock can be supported on the planar, uninterrupted upper surface of the table over the sheet bending brake.

7. The combined sheet bending brake, table and coil support set forth in claim 6 wherein said base of said brake comprises spaced rails, said means for mounting said coil support base on said bending brake base comprising a plurality of members extending between said bases.

8. The combined sheet bending brake, table and coil support set forth in claim 7 wherein said rails are generally tubular and said mounting members telescope within said rails.

9. The combined sheet bending brake, table and coil support set forth in claim 6 wherein means are provided for mounting said table for movement from a position generally horizontal with respect to said clamping surface to a position rearwardly of said base of said sheet brake.

10. The combined sheet bending brake, table and coil support set forth in claim 6 wherein said means for mounting said brake comprise a plurality of longitudinally spaced brackets pivoted to said sheet bending brake and supporting said table.

11. The combined sheet bending brake, table and coil support set forth in claim 10 wherein said sheet bending brake includes a plurality of C-shaped members positioned on said base at longitudinally spaced points, each said C-shaped member comprising a lower arm fixed to said base and an upper arm spaced from and overlying said lower arm, said first member being fixed on the lower arms of said C-shaped members, said brackets being pivoted to said C-shaped members adjacent the juncture of the upper and lower arms.

12. The combined sheet bending brake, table and coil support set forth in claim 11 wherein said bracket includes portions thereof adapted to engage portions of the upper arm to position said table in horizontal position.

13. The combined sheet bending brake, table and coil support set forth in claim 12 wherein said last mentioned means comprises a member on at least some of said brackets adapted to extend horizontally and engage a laterally extending portion of said C-shaped members.

14. A combined sheet bending brake, table and coil support comprising a sheet bending brake including a base comprising spaced longitudinally extending rails, said sheet bending brake including a plurality of C-shaped members positioned on said rails at longitudinally spaced points, each said C-shaped member comprising a lower arm fixed to said base and an upper arm spaced from and overlying said lower arm, a first member having a clamping surface mounted on lower arms, a second member having a bending surface, means for hinging said second member to said first member about a longitudinal axis, an anvil member extending longitudinally of said first bending member, and means for clamping a workpiece by applying pressure to said anvil member to clamp a workpiece on the clamping surface of the first member, a table mounted on said sheet bending brake, said table overlying said C-shaped members and extending horizontally and rearwardly from the anvil and longitudinally along the base, said table having an upper surface substantially planar and uninterrupted, and a coil support comprising a base, a pair of supports carried by the base of the coil support, said supports including a plurality of rollers for supporting a roll of sheet stock, means carried longitudinally of the base of the coil stand and transversely of the base of the sheet bending brake for defining a flat clamping surface, and means for clamping the edge of the uncoiled sheet stock against said last mentioned surface, and means for mounting the base of said coil stand on the base of said sheet metal brake such that the axis of the roll of sheet stock extends transversely of the longitudinal axis of the sheet bending brake, said means for mounting said coil support base on said bending brake base comprising a plurality of mounting members, said rails of said brake being generally tubular and said mounting members being telescoped within said rails, said table being oriented over said sheet bending brake in a position adjacent the clamping means of the coil support so that uncoiled sheet stock can be supported on the planar, uninterrupted upper surface of the table over the sheet bending brake.

15. The combined sheet bending brake, table and coil support set forth in claim 14 wherein means are provided for mounting said table for movement from a position generally horizontal with respect to said clamping surface to a position rearwardly of said base of said sheet brake.

16. The combined sheet bending brake, table and coil support set forth in claim 15 wherein said means for mounting said table comprise a plurality of longitudinally spaced brackets pivoted to the upper arms of said C-shaped members of said sheet bending brake and supporting said table.

17. The combined sheet bending brake, table and coil support set forth in claim 16 wherein said brackets include portions thereof adapted to engage portions of the upper arm to position said table in horizontal position.

18. The combined sheet bending brake, table and coil support set forth in claim 17 wherein said last mentioned means comprises a member on at least some of said brackets adapted to extend horizontally and engage a laterally extending portion of said C-shaped members.

19. A combined sheet bending brake and table comprising a sheet bending brake including a base comprising spaced longitudinally extending rails, said sheet bending brake including a plurality of C-shaped members positioned on said rails at longitudinally spaced points, each said C-shaped member comprising a lower arm fixed to said base and an upper arm spaced from and overlying said lower arm, a first bending member having a clamping surface mounted on lower arms, a second member having a bending surface, means for hinging said second member to said first member about a longitudinal axis, an anvil member extending longitudinally of said first bending member, and means for clamping a workpiece by applying pressure to said anvil member to clamp a workpiece on the clamping surface of the first member, and a table mounted on said sheet bending brake, said table overlying said C-shaped members extending horizontally and rearwardly from the anvil and longitudinally along the base, said table having an upper surface substantially planar and uninterrupted, means for mounting said table for movement from an operative position generally horizontal with respect to said clamping surface for supporting workpieces to an inoperative position rearwardly of said base of said sheet brake.

20. The combined sheet bending brake and table set forth in claim 19 wherein said means for mounting said table comprises a plurality of longitudinally spaced brackets pivoted to the upper arms of said C-shaped members of said sheet bending brake and supporting said table.

21. The combined sheet bending brake and table set forth in claim 20 wherein said brackets include portions thereof adapted to engage portions of the upper arm to position said table in horizontal position.

22. The combined sheet bending brake and table set forth in claim 21 including a member on at least some of said brackets adapted to extend horizontally and engage a laterally extending portion of said C-shaped members.

* * * * *